US011939869B2

(12) United States Patent
Zaayman

(10) Patent No.: US 11,939,869 B2
(45) Date of Patent: Mar. 26, 2024

(54) MINERAL BIT AND CUTTING TIP THEREFOR

(71) Applicant: Carriere Industrial Supply Limited, Lively (CA)

(72) Inventor: Oswald D. Zaayman, Westcliffe, CO (US)

(73) Assignee: CARRIERE INDUSTRIAL SUPPLY LIMITED, Lively (CA)

( * ) Notice: Subject to any disclaimer, the term of this patent is extended or adjusted under 35 U.S.C. 154(b) by 0 days.

(21) Appl. No.: 17/471,690

(22) Filed: Sep. 10, 2021

(65) Prior Publication Data

US 2022/0082016 A1 Mar. 17, 2022

Related U.S. Application Data

(60) Provisional application No. 63/077,015, filed on Sep. 11, 2020.

(51) Int. Cl.

| | |
|---|---|
| ***E21C 35/19*** | (2006.01) |
| ***E21C 35/18*** | (2006.01) |
| ***E21C 35/183*** | (2006.01) |

(52) U.S. Cl.

CPC ..... *E21C 35/19* (2013.01); *E21C 35/18* (2013.01); *E21C 35/1835* (2020.05); *E21C 35/1837* (2020.05)

(58) Field of Classification Search

CPC ..... E21C 35/1837

See application file for complete search history.

(56) References Cited

U.S. PATENT DOCUMENTS

| | | | | | |
|---|---|---|---|---|---|
| 3,010,709 | A * | 11/1961 | Bentley | E21C 35/18 | 299/112 R |
| 4,101,318 | A * | 7/1978 | Rudy | C22C 1/1036 | 164/57.1 |
| 4,143,920 | A * | 3/1979 | Haddock | E21B 10/58 | 299/112 R |
| 4,637,658 | A * | 1/1987 | Annipajo | E21C 35/183 | 175/420.1 |
| 5,092,310 | A * | 3/1992 | Walen | E21C 35/183 | 299/112 R |
| 5,235,961 | A * | 8/1993 | McShannon | E21C 35/183 | 407/42 |
| 5,297,853 | A * | 3/1994 | Sollami | E21C 35/183 | 299/112 R |
| 5,319,855 | A * | 6/1994 | Beevers | E21C 35/183 | 299/112 R |
| 5,702,160 | A * | 12/1997 | Levankovskii | E21C 35/183 | 299/113 |
| 8,136,887 | B2 * | 3/2012 | Hall | E21C 35/183 | 299/113 |
| 9,303,511 | B2 * | 4/2016 | Paros | E21B 10/58 | |
| 9,434,091 | B2 * | 9/2016 | Burton | E21C 35/183 | |
| 10,294,787 | B2 | 5/2019 | Zaayman | | |

* cited by examiner

*Primary Examiner* — Janine M Kreck

(74) *Attorney, Agent, or Firm* — Palmer Dzurella

(57) ABSTRACT

Provided is a mineral bit and cutting tip therefor. The mineral bit is configured to penetrate geological materials in a dig face to effectively process the same. The mineral bit includes various geometric constraints to increase structural integrity and penetration capability. The cutting tip may have increased durability and may be self-sharpening.

19 Claims, 12 Drawing Sheets

MINERAL BIT AND CUTTING TIP THEREFOR

CROSS-REFERENCE TO RELATED APPLICATIONS

The present application claims priority of U.S. Provisional Application No. 63/077,015 filed on Sep. 11, 2020, incorporated herein by reference in its entirety.

TECHNICAL FIELD

The following relates to excavation and mining operations, and more particularly to mineral bits for use during such operations.

BACKGROUND

Mineral bits, also known as drill bits, cutter bits, cutter picks, cutting tips, drill tips, etc. are used in excavation and mining operations. Such bits are typically used on rock boring drill machines for underground earth moving activities that are generally carried out in underground mines and during tunnel boring operations. Mineral bits are typically releasably retained via suitable mounts secured to a piece of equipment.

Mineral bits are considered a consumable item which may need replacement after a period of use due to failure/fracture (e.g., breaking) or due to partial or complete loss in performance (e.g., cutting ability) due to wear. Depending on the particular application and forces to which a mineral bit may be subjected to, breaking or other conditions requiring replacement of mineral bits can occur on a regular basis. In some applications the replacement of mineral bits can be relatively difficult and time consuming and can result in significant downtime of an associated piece of equipment and hence increased costs of an excavation or mining-related operation.

In view of the foregoing, it is desirable to develop an improved mineral bit.

SUMMARY

In one aspect, provided is a mineral bit for use during excavation and mining operations, the mineral bit having a front region and an opposite rear region, the bit further comprising: a head portion; a mounting portion secured to the head portion and configured to be releasably retained by a mount; a rounded transition disposed in the front region of the bit between the head portion and the mounting portion and configured to provide a clearance between the head portion and the mount when the mounting portion is releasably retained by the mount; a rear shoulder surface disposed on the head portion in the rear region of the bit and configured to interface with the mount when the mounting portion is releasably retained by the mount; the mounting portion having a front face, an opposite rear face, and side faces therebetween; the head portion further comprising: a leading edge connected to the rounded transition and extending away from the mounting portion at first angle with respect to the front face of the mounting portion, the leading edge being configured to releasably retain a cutting tip; a top face opposite the interface between the mounting portion and the head portion, and extending between a distal end of the leading edge and the rear shoulder, wherein the top face includes first and second surfaces connected by a rounded transition section, the first surface extending from the distal end of the leading edge to the transition section, the second surface extending from the transition section to the shoulder; and first and second side faces each extending from the interface to the upper face.

In an implementation, the first angle is about 22 degrees or greater.

In another implementation, a second angle is defined between the second surface and the front face of the mounting portion, the second angle being about 52 degrees or less.

In yet another implementation, a third angle is defined between the first surface and the leading edge, the third angle being about 49 degrees or less.

In yet another implementation, the leading edge includes an attachment face including a concave surface for engaging a convex surface of the cutting tip.

In yet another implementation, the concave surface is arcuate.

In another aspect, provided is a mineral bit having a cutting tip attachment face for releasably retaining a cutting tip, the attachment face being a concave surface for engaging a convex surface of the cutting tip.

In an implementation, the concave surface is arcuate.

In yet another aspect, provided is a cutting tip for engagement by a mineral bit for use during excavation and mining operations, the cutting tip comprising: a base surface; a rear face; a top face; a front face comprising a cutting face opposite the rear face, and first and second side faces extending from respective ends of the cutting face to the rear face; the rear face having a greater width than the front face; and a penetration tip.

In an implementation, the cutting tip is made from a carbide material.

In another implementation, the carbide material is tungsten carbide.

In yet another implementation, the carbide material is chromium carbide.

In yet another implementation, the rear face and the base surface form an angle of approximately 90 degrees.

In yet another implementation, the front face is at an angle of from approximately 95 degrees to approximately 100 degrees relative to the base surface.

In yet another implementation, the front face is at an angle of from approximately 46 degrees to approximately 50 degrees relative to the top face.

In yet another implementation, the front face is at an angle of approximately 50 degrees relative to the top face.

In yet another implementation, the cutting face has a width of from approximately 10% to approximately 40% of the front face.

BRIEF DESCRIPTION OF THE DRAWINGS

Embodiments will now be described with reference to the appended drawings wherein.

DETAILED DESCRIPTION

One or more of the terms "front", "back", "rear", "vertical", "vertically", "horizontal", "horizontally", "top", "bottom", "upwardly", "downwardly", "inwardly", "outwardly", "upper", "lower", "right" and "left" are used throughout this specification. It will be understood that these terms are not intended to be limiting. These terms are used for convenience and to aid in describing the features herein, for instance as illustrated in the accompanying drawings.

Figure 1A:
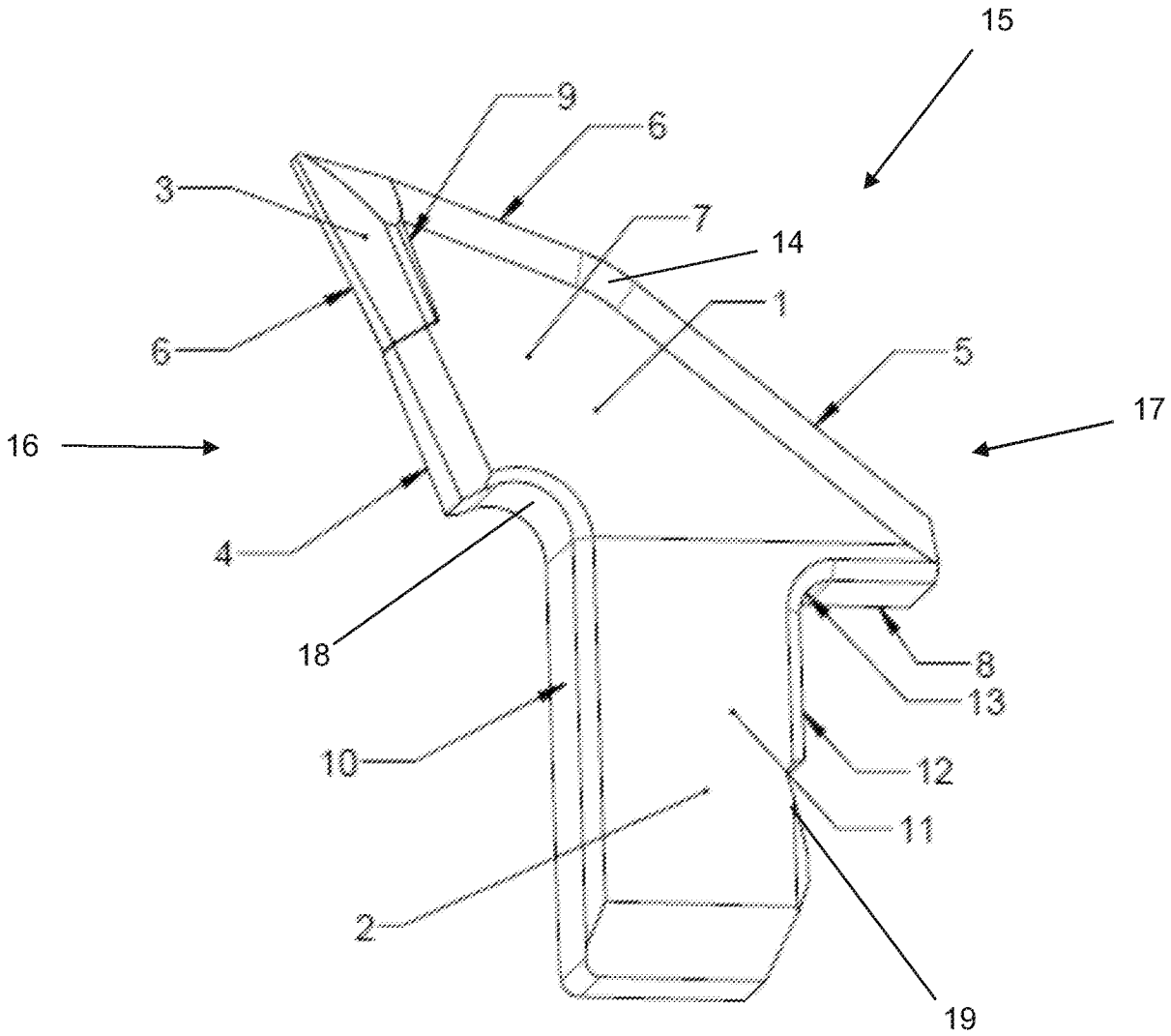
FIG. 1A is a side elevation view of an example embodiment of a mineral bit.
Figure 1B:
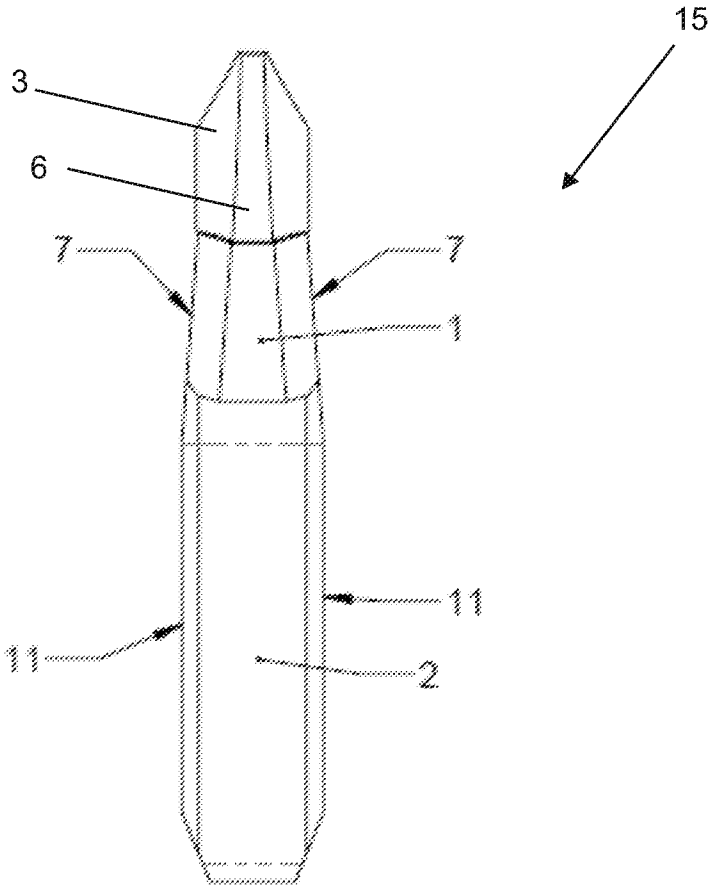
FIG. 1B is a front elevation view of the mineral bit shown in FIG. 1A.

FIGS. 1A and 1B illustrate an example embodiment of a mineral bit 15 according to the present disclosure. The mineral bit 15 may be used on geological (e.g., rock) boring drill machines (not shown) for underground earth moving activities typically conducted in underground mines, and also tunnel boring operations. Such drill machines may have a cylindrical part such as a drum configured to be rotated while being driven into the rock/dirt face. Such a rotating drum may be oriented with its center axis parallel to the rock face or perpendicular to the rock face. For example, a surface of the rotating drum that would come into contact with the rock face could comprise a plurality of such mineral bits 15 arranged in a particular fashion so as to cut into the rock face and thereby facilitate removal of the rock/dirt by the machine. Mineral bit 15 may have different configurations to those shown herein. The term "mineral bit" is intended to encompass other types of bits/tools also known as a drill bits, cutter bits, cutter picks, drill tips, etc., and the like.

The mineral bit 15 may be a consumable part which may need replacement after a period of use. For example, replacement of mineral bit 15 may be necessary due to failure/fracture (e.g., breaking) of mineral bit 15 or due to partial or complete loss in performance (e.g., cutting ability) of mineral bit 15 due to wear. The mineral bit 15 may be made from materials and processes similar to those used for fabricating conventional bits. For example, the mineral bit 15 may be forged or cast from a suitable steel.

The mineral bit 15 may comprise a head portion 1 and a shank, or mounting part 2 Head portion 1 may be configured to contact, cut and/or otherwise process rock/dirt or other type of mineral. The head portion 1 may comprise a front region 16, which may face mineral (e.g., rock/dirt) during use and a rear region 17, which may be disposed opposite the front region 16. Head portion 1 may, for example, be configured to have an integrally formed cutting/processing region and/or may be configured to receive and hold a replaceable cutting tip/insert, or cast bit, which may be made of a material having a relatively high wear resistance (e.g., carbide and/or hardened steel). The principles discussed with respect to the replaceable cutting tip may also apply to a mineral bit having an integral cutting tip (i.e., a tip that is not replaceable). In the example embodiment shown, the head portion 1 comprises an attachment face 9 configured to removably receive a cutting tip 3.

The head portion further comprises a front leading face 4, a rear face 5, a top face 6 (which forms part of the cutting tip 3 in this example embodiment), two side faces 7, a rear shoulder 8. The shank 2 may comprise a singular rectangular shaped part extending from the head portion 1, with the shank 2 exhibiting various cut-outs along its length and shape changes towards the bottom end. The shank 2 may comprise a front face 10, two side faces 11 and a rear face 12. The bit 15 comprises a rear rounded transition 13 extending from the rear face 12 of the shank 2 to the rear region 17 of the head portion 1, particularly the shoulder 8. The bit 15 further comprises a front rounded transition 18 extending from the front face 10 of the shank 2 to the leading edge 4 in the front region 16 of the head portion 1.

The shank 2 may be secured to (e.g., integrally formed with) the head portion 1 and may be used for releasably coupling mineral bit 15 to a drilling machine or other suitable piece of equipment. The releasable coupling of mineral bit 15 to other equipment may facilitate the replacement of mineral bit 15 if and when necessary. Accordingly, the shank 2 may be configured to be releasably retained in a suitable mount (not shown) that is secured to a piece of equipment (not shown). The shank 2 may include a locking notch 19 that may be used to releasably retain the shank 2 in place during use.

The environment in which mineral bit 15 may operate may require unique considerations for the shape and geometry of mineral bit 15 and an associated mount. For example, mineral bit 15 may experience severe forces and torques in many directions as it passes over the rough rock face, while cutting a path or slot through the rock. These varying forces and torques can occur many times per second and hence cause vibrations of varying magnitudes and frequencies, resulting in what can be considered a fatigue loading environment. In some embodiments, one or both of the front rounded portion 18 and rear rounded portions 13 may provide improved resistance to fatigue crack initiation and eventual fatigue failure in comparison with other known bits having sharp transitions. This may be because rounded transitions can have lower stress concentrations as compared to sharp transitions. Front regions of rectangular mineral bits may be subject to relatively high stresses including relatively higher tensile stresses than in other regions of such mineral bits. The reduction or elimination of sharp internal corners or transitions located in front regions of mineral bits can, in some cases, reduce the likelihood of fracture.

Figure 2:
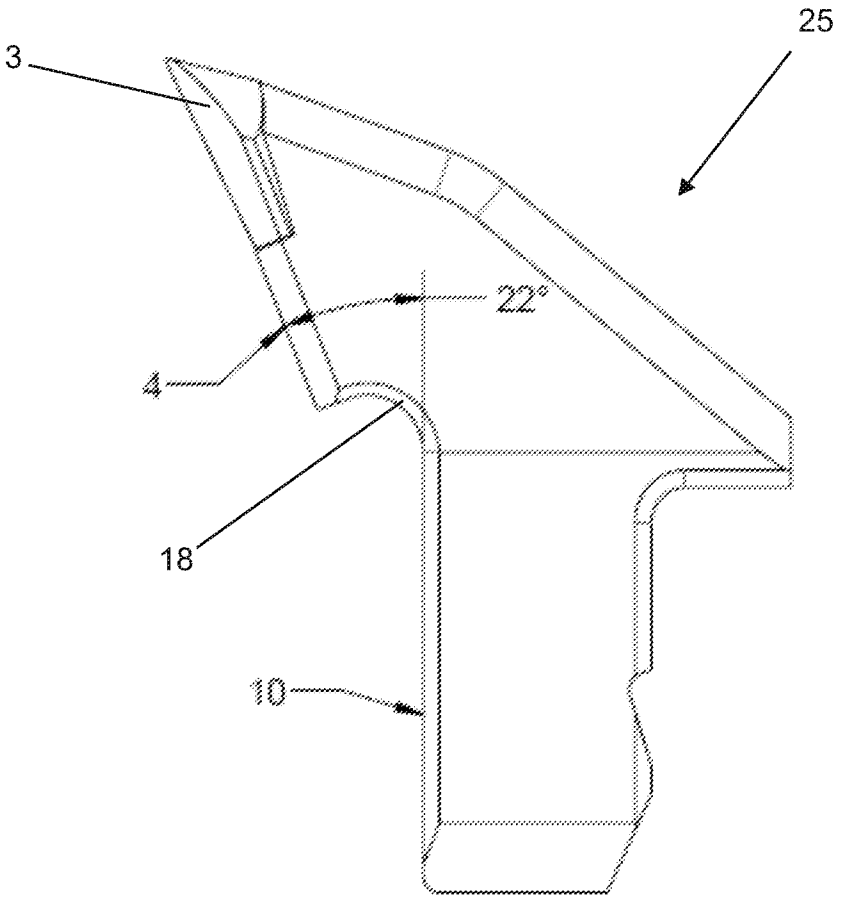
FIG. 2 is a side elevation view of a mineral bit, illustrating a geometric constraint.

FIG. 2 illustrates a bit 25 similar to the bit 15 illustrated in FIGS. 1A and 1B. The mineral bit 25 is configured such that there is an angle of approximately 22 degrees between the shank 2, particularly the front face 10 thereof, and the leading face 4 of the head portion 1. The aforementioned angle may be referred to herein as the front leading face angle or the 4/10 face angle since it is the angle between the leading face 4 and the front face 10 of the shank. The 4/10 face angle may be from approximately 4 degrees to approximately 25 degrees. It has been found that the 4/10 face angle can affect the ability of the bit 15 to penetrate materials. For example, it was found that a 4/10 face angle smaller than approximately 22 degrees may result in the bit 15 riding on top of, rather than penetrating, material in a dig face, specifically when the material is soft and flaky. For penetrating geological materials, which may include soft, flakey materials or more dense or rigid materials, the front leading face angle is preferably at least approximately 12 degrees, and more preferably at least 22 degrees.

Figure 3:
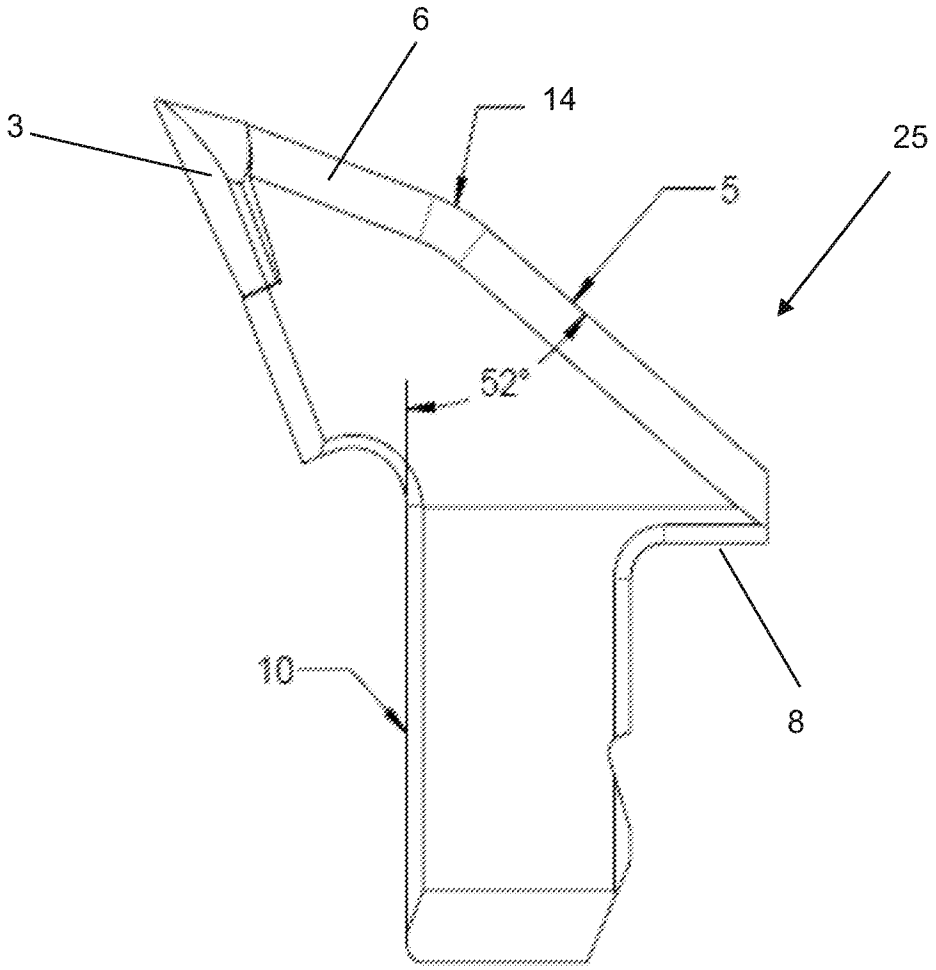
FIG. 3 is a side elevation view of the mineral bit shown in FIG. 2, illustrating another geometric constraint.

FIG. 3 illustrates another example embodiment of a mineral bit 25 similar to bits 15 and 25. The angle formed between the rear face 5 of the head portion 1 and the front face 10 of the shank 2 is approximately 52 degrees. This angle may be referred to as the "5/10 face angle", because it is the angle between faces 5 and 10. Provided the 4/10 face angle and the (FIG. 2) top 6 to leading 4 face angle (discussed in detail with reference to FIG. 4) are sized according to the constraints described herein the transition of the rear face 5 into the top face 6 causes a "hump" 14 which imbues the head portion 1 and cutting tip 3 with structural strength during dig operation. The 5/10 face angle may be small enough to create this 'hump' in the transition between the rear and the top face, but not so small that the shoulder 8 is of insufficient size (i.e., such that the shoulder 8 does not provide enough surface area) to act on the bit mount (not shown) during operation.

Figure 4:
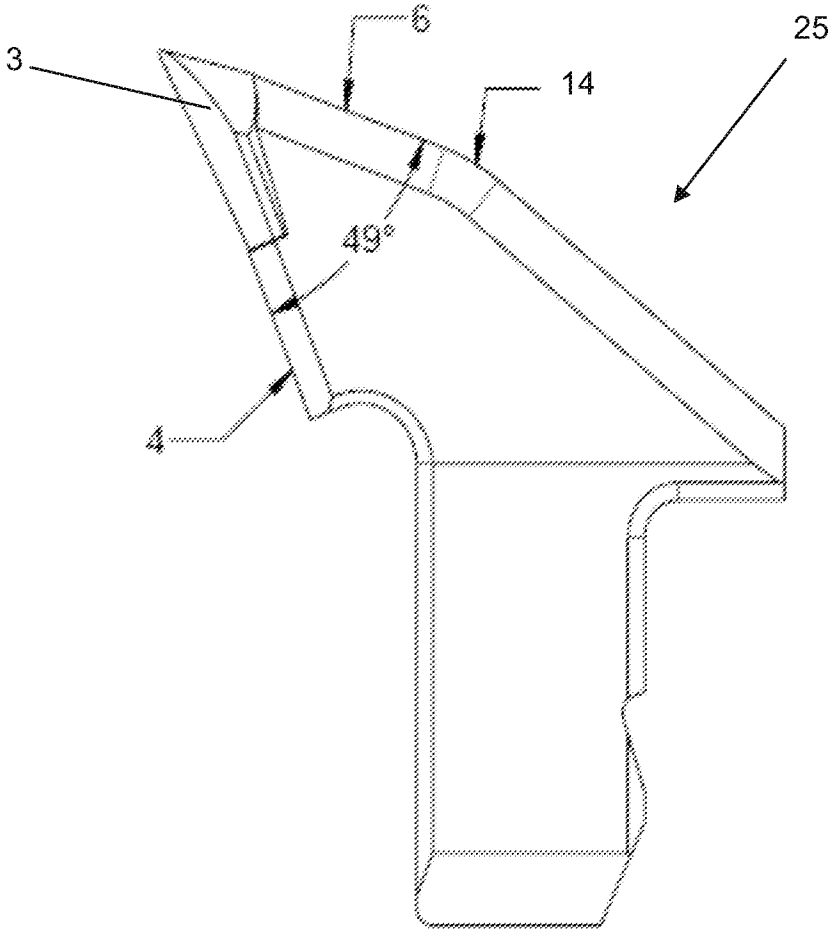
FIG. 4 is a side elevation view of the mineral bit shown in FIGS. 2 and 3, illustrating yet another geometric constraint.

FIG. 4 illustrates that there is a 49 degree angle between the top 6 and leading 4 faces of the head portion 1. This angle may be referred to as the "6/4 face angle", because it is the angle between faces 6 and 4. When the 6/4 face angle is approximately 49 degrees or less, the tip may be encouraged to penetrate into material to be removed rather than to ride on top of such material in the dig face. Such a 6/4 face angle may prevent the top 6 face from providing a relatively flat surface that may ride over and thus not penetrate the material in a dig face. It may be that providing a 6/4 face angle of approximately 49 degrees or less is particularly helpful for penetrating soft, flakey geological materials.

The 6/4 face angle (FIG. 4) can be sized in conjunction with the 5/10 face angle (FIG. 3). The selected magnitude of each of these two angles determines the size of the 'hump' transition 14 between the rear and the top face. The 4/10, 5/10 and 6/4 face angles may constrain one another. That is, the 4/10, 5/10 and 6/4 face angles may be varied so long as the 4/10 face angle remains greater than approximately 4 degrees, the 6/4 face angle is equal to or less than approximately 49 degrees, the 5/10 face angle is equal to or less than approximately 52 degrees, the transition 14 is generally hump-shaped and the shoulder 8 has sufficient surface area to act on the bit mount. Preferably, the 5/10 face angle may be from approximately 49 degrees to approximately 52 degrees and the 6/4 face angle may be from approximately 45 degrees to approximately 49 degrees. Preferably, the 4/10 face angle may be from approximately 12 degrees to approximately 25 degrees, and more preferably from approximately 22 degrees to approximately 25 degrees.

Figure 5:
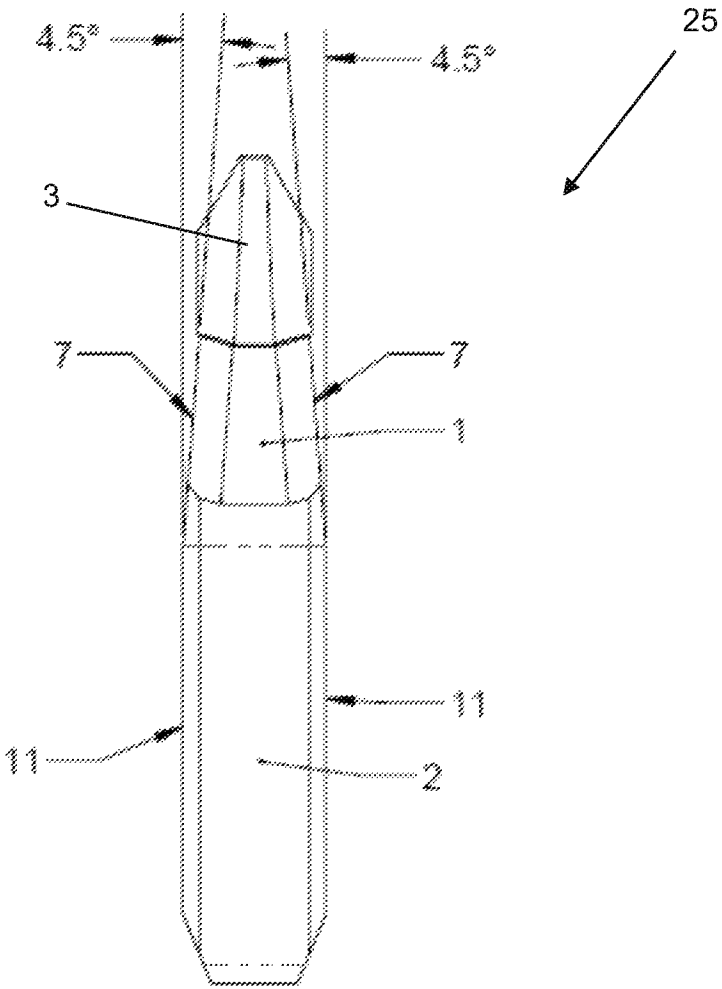
FIG. 5 is a front elevation view of the mineral bit of FIGS. 2-4, showing yet another geometric constraint.

FIG. 5 is a front elevation view of the mineral bit 25, illustrating another dimensional constraint for improving bit 25 performance. As shown, each of the side faces 7 of the head portion 1, makes an angle of approximately 4.5 degrees with the corresponding side face 11 of the shank 2. This angle may be from about 3 degrees to about 6 degrees. In order to provide a shape conducive to digging into any material, the sides 7 of the head portion 1 taper toward one another toward the top face 6 with a minimum angle of approximately 4.5 degrees on either side. This taper may allow for additional penetrating capability of the cutting tip 3.

Figures 6A, 6B:
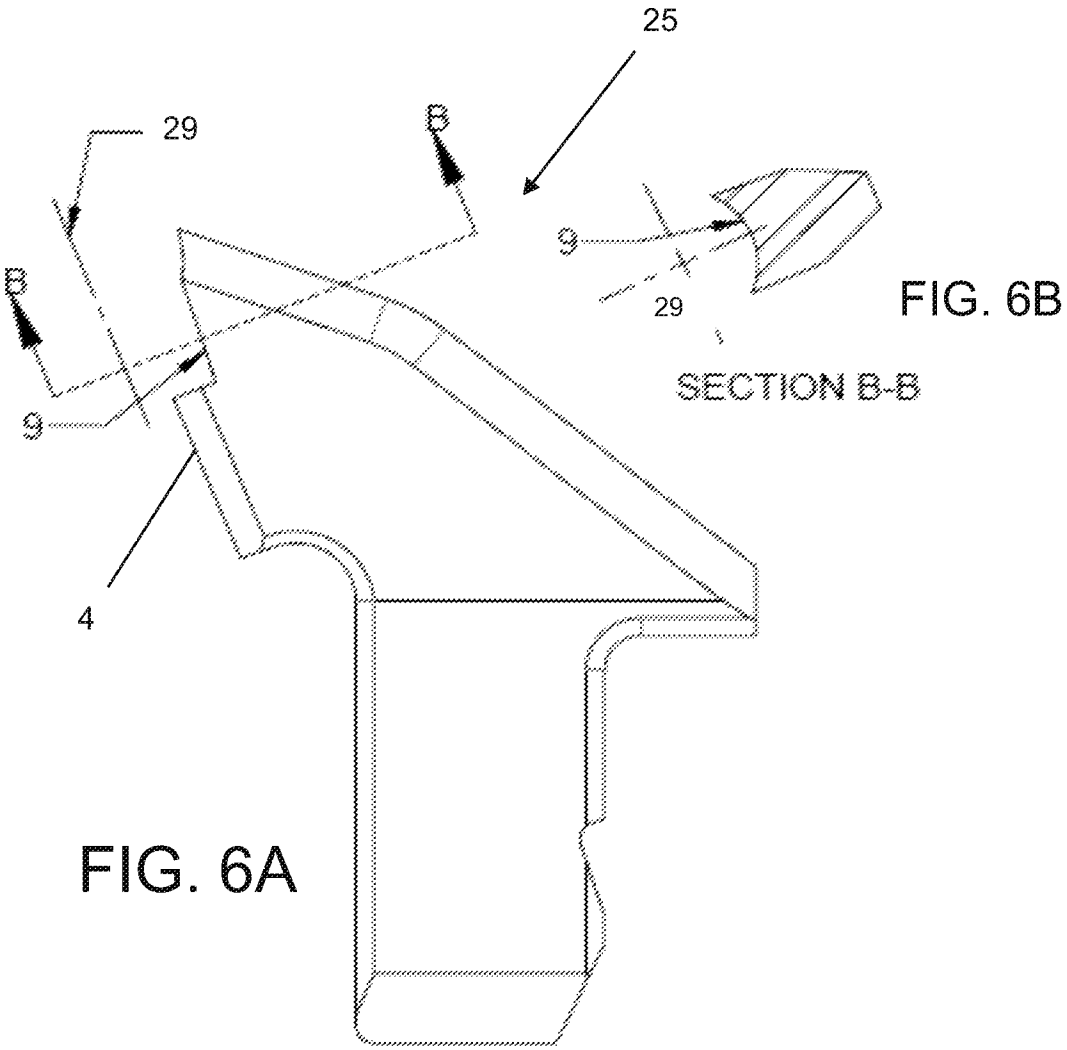
FIG. 6A is a side elevation view of the mineral bit of FIGS. 2-5, with the cutting tip removed.
FIG. 6B is a cross-sectional view taken along line B-B drawn in FIG. 6A, showing a concave attachment face defined in the head portion.

FIGS. 6A and 6B show the attachment face 9 configured to receive the cutting tip 3. As illustrated in FIG. 6B, the attachment face 9 is concave. In this example embodiment, the centerline 29 of the concave/curved attachment face (9) is generally parallel with the front leading face (4) of the head portion 1 so that if the cast tip 3 is mounted to the attachment face, the tip 3 may be oriented similarly to tip 30 discussed with respect to FIGS. 8-10.

The cutting tip 3 can be attached to the head portion 1 by fitting brazing material between a flat surface on the tip and a mating flat surface on the cast bit body. In such a configuration the braze material may carry some or substantially all of the shear forces when the bit/tip assembly operates. Failure of the brazed attachment can be inhibited by providing a curved surface where the brazing is not in a single plane and where shear force is also handled by the cast bit body material in the curve. In other example embodiments the centerline 29 of the curved attachment face 9 may be misaligned with the leading face 4, i.e., the centerline 29 can be oriented any way with respect to the leading face 4, including perpendicularly. Furthermore, the curved attachment face 9 need not be a perfect "half-moon" shape as illustrated in FIG. 6A. The curved attachment face 9 can be a non-uniform shape, or can have another geomantic shape, e.g., polygonal (e.g., faceted, hexagonal).

Figure 7B:
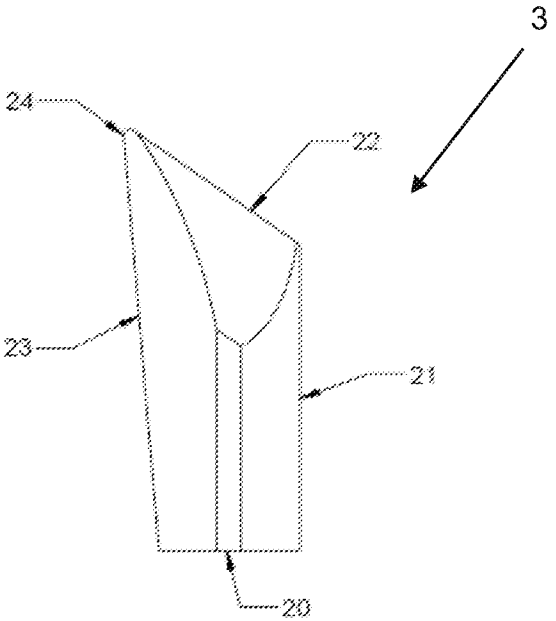
FIG. 7B is a side elevation view of the cutter bit in FIG. 7B.
Figure 7A:
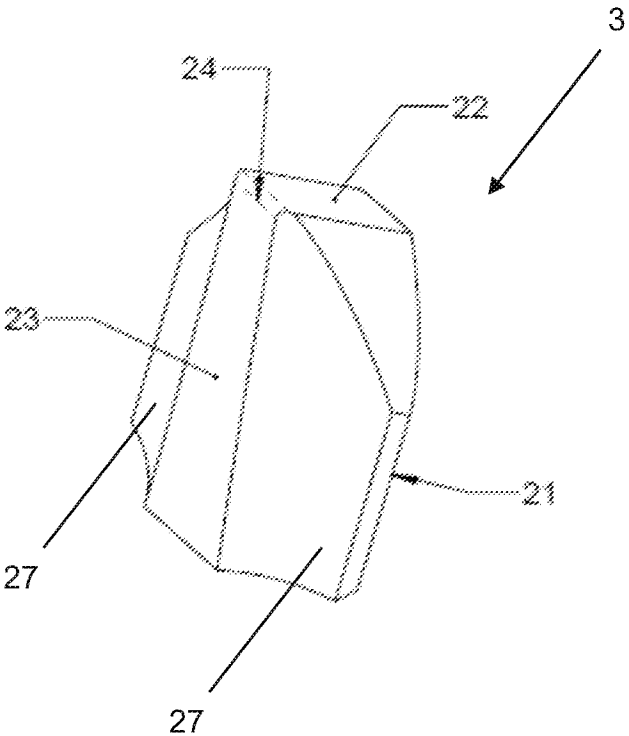
FIG. 7A is an isometric view of a cutter bit.

FIGS. 7A and 7B illustrate a cutting tip 3, made from a relatively hard material, preferably tungsten carbide or chromium carbide, comprising a base surface 20, rear face 21, top face 22, front leading face 23, and a penetration tip 24. The front face 23 may also be referred to as the cutting face 23.

Figures 8, 9, 10:
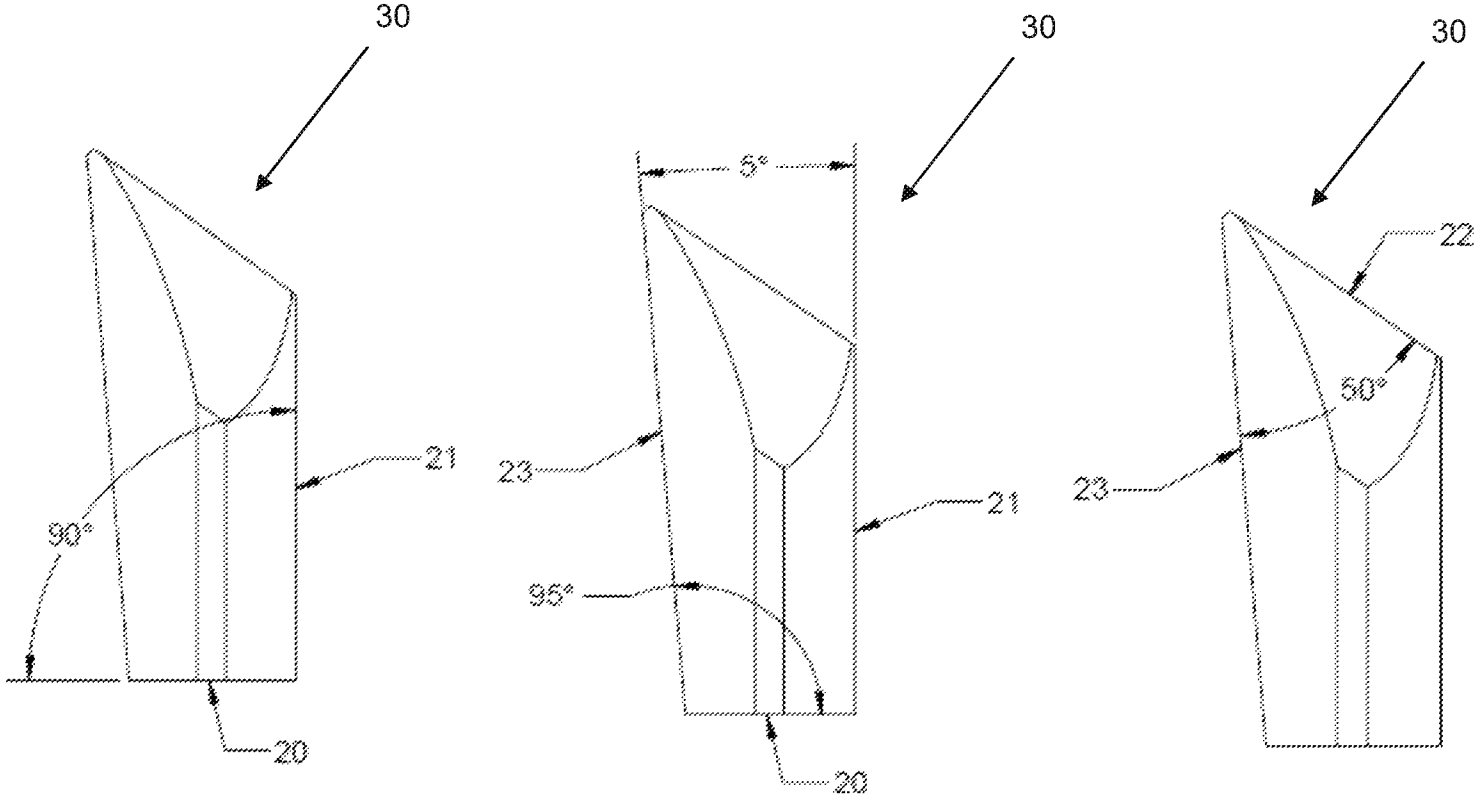
FIG. 8 is a side elevation view of a cutter bit, illustrating a geometric constraint.
FIG. 9 is a side elevation view of the cutter bit shown in FIG. 8, illustrating a geometric constraint.
FIG. 10 is a side elevation view of the cutter bit in FIGS. 8 and 9, illustrating yet another geometric constraint.

FIGS. 8-10 illustrate an example embodiment of a cutting tip 30 similar to the cutting tip 3, with geometric constraints for improving performance. Turning to FIG. 8, in an embodiment the angle between the rear face 21 and the base face 20 may be approximately 90 degrees, and may alternatively be close to or equal to 90 degrees. The precision of this dimension (as for others disclosed herein) may be understood in view of manufacturing tolerances. This is to provide clear orientation of the cutting tip 30 when mounted or attached to the cutting bit body. Similarly, it provides ease of machining the attachment faces (i.e., pocket/mounting faces) of a mineral bit (e.g., the mineral bit 15) to allow for attachment of the cutting tip 30. The front leading face 23 of the cutting tip 30 may be angled forward with an angle of from approximately 95 degrees to approximately 100 degrees, relative to the base face 20 of the cutting tip 3 (FIG. 9). It follows that the angle between the front leading face 23 and the rear face 21 may be from approximately 5 degrees to approximately 10 degrees. This ensures a difference in angle between the front leading face 23 of the cutting tip 30 and the front face 4 of the head portion 1 to which the tip 30 may be attached. This difference in angle may provide necessary space to encourage dislocated material coming from the cutting action to flow away from the front leading face 23 and the penetration tip 24 of the cutting tip 30 as well as the front face 4 of the head portion 1 during operation.

Turning to FIG. 10, the angle between the front leading face 23 and the top face 22 of the cutting tip 30 may be from approximately 46 degrees to approximately 50 degrees, and preferably about 50 degrees. This angle is preferably not less than the equivalent angle of the head portion 1 which is the 6/4 face angle. The purpose of this angle is to inhibit the top face 22 of the cutting tip 30 from pressing on or riding over the surface of the material to be cut, and accordingly allowing the penetration tip 24 to penetrate into the material to be cut. The angle may also allow the penetration tip 24 to retain its shape and therefore remain 'sharp' during operation, thereby generally retaining its penetration capability.

Figure 11B:
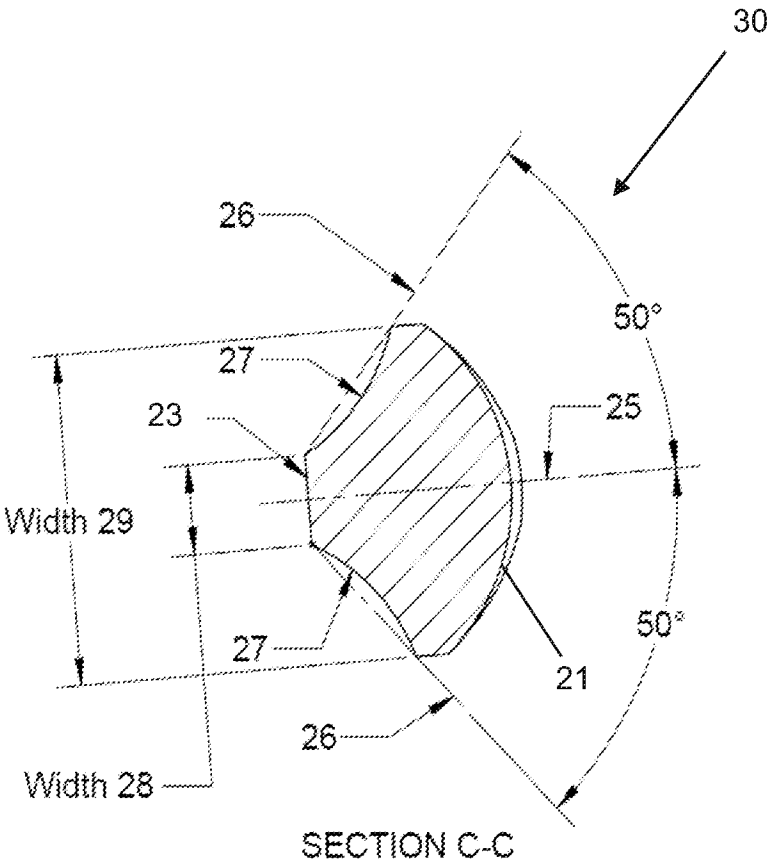
FIG. 11B is a cross-sectional view of the cutter bit in FIG. 11A.
Figure 11A:
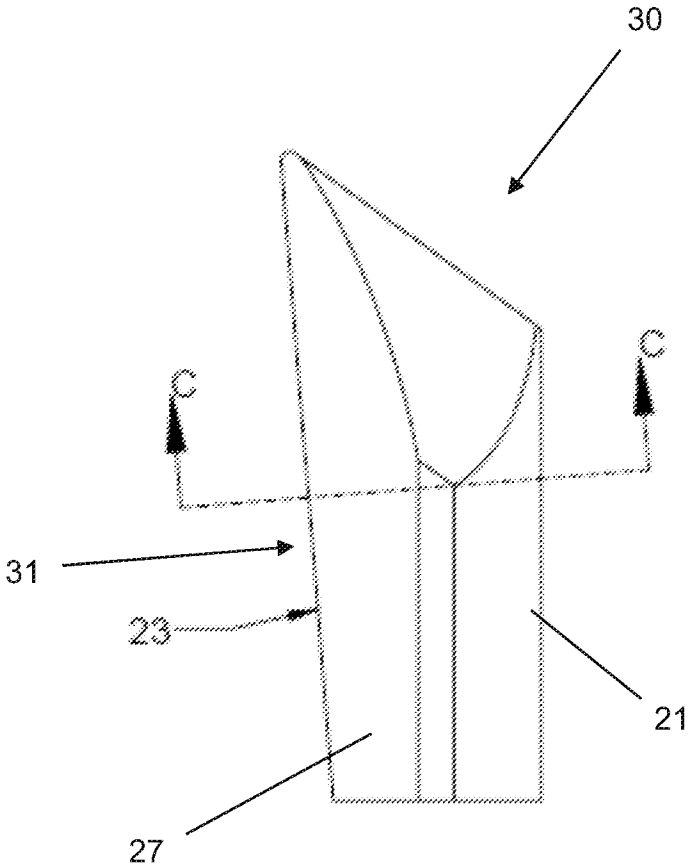
FIG. 11A is a side elevation view of the cutter bit in FIGS. 8-10 having a cross-sectional cut line C-C drawn thereon.

With reference to FIGS. 11A and 11B, the front face 23 of the cutting tip 30 may be split on the centerline 25 for a distance of "Width 28" which may from approximately 10% to approximately 40% of the frontal width ("Width 29") of the cutting tip 30, so that portions 27 beginning on either side of the front leading face 23 may be angled generally towards the rear face 21 of the cutting tip with an angle 26 of between approximately 20 degrees and approximately 60 degrees, preferably approximately 50 degrees, relative to the center plane 25. The portions 27 and the front leading face 23 may be collectively referred to as a front face 31. Furthermore, the portions 27 of the front face 31 which are angled rearwards in this manner, may include concave hollows. The front face 31 can be substantially flat. The depth of the concave hollows may be limited by the cutting tip 30 core material in order to maintain a desired structural integrity.

The two angled portions 27 can encourage the material removed during the cutting process to flow around the front face 31 of the cutting tip 30. Concave indentations at the angled portions 27 can assist in this process by further promoting flow of material around the front face 31. The front leading face 23 can act as a cutting edge during the dig process, encouraging penetration of the cutting tip 30 into the cut material. As these concave indentations are worn down by cut material flowing thereacross, the cutting tip 30 can generally retain its shape and therefore remain generally sharp enough for the cutting tip 30 maintain its penetration capability. As such, the cutting tip 30 might be considered "self-sharpening".

Figure 12B:
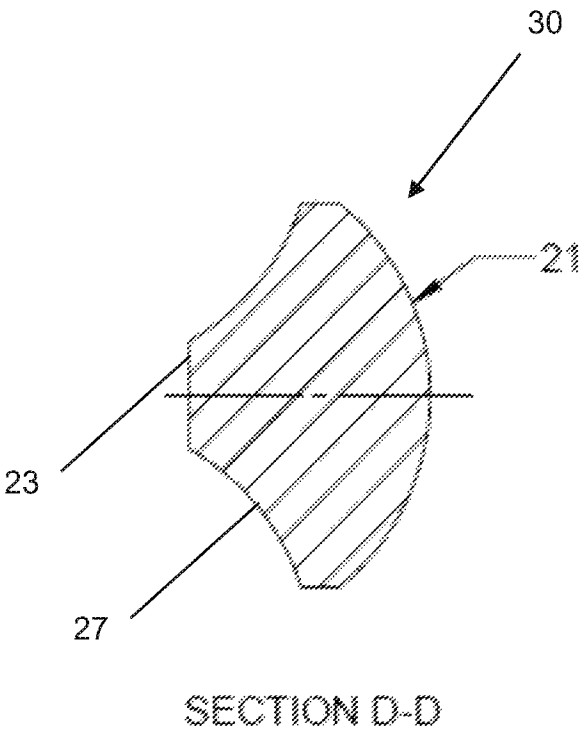
FIG. 12B is a cross-sectional view of the cutter bit in FIG. 12A.
Figure 12A:
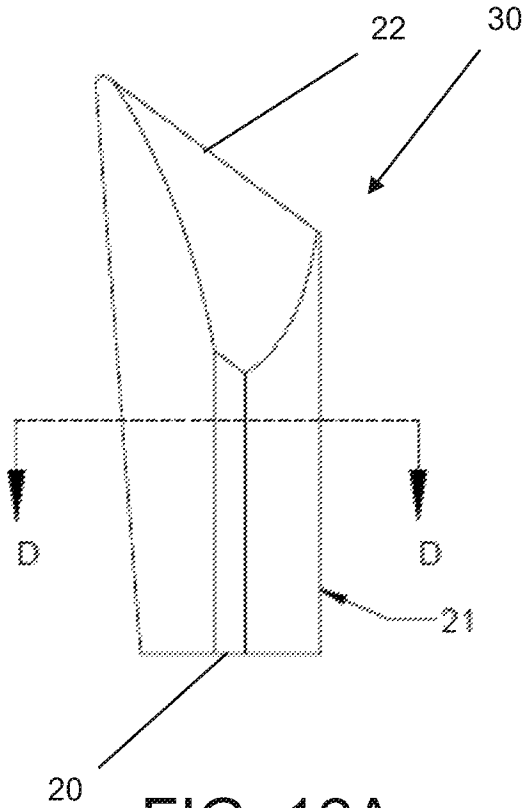
FIG. 12A is a side elevation view of the cutter bit in FIGS. 8-11B having a cross-sectional cut line D-D drawn thereon.

As illustrated in, e.g., FIGS. 12A and 12B, the rear face 21 of the cutting tip 30 may have a convex shape, e.g. a curved shape bulging generally outwardly, when viewed from the top or bottom face (22 and 20). This convex shape of the rear face of the cutting tip may permit mounting or attaching it to the head portion 1 where the attachment face 9 is similarly formed (see, e.g., the concave attachment face 9 in FIG. 6B). The cutting tip 3 may be attached to the head portion 1 by fitting brazing material between a generally flat surface on the tip and a generally flat mating surface on the head portion 1. In such a configuration the braze material may carry at least some, and preferably a majority or all shear forces when the bit/tip assembly operates. Failure of the brazed attachment may be inhibited by providing a curved surface where the brazing is not entirely, predominantly, or at all in a single plane and where any shear force may also be endured by the head portion 1 material in the curve.

Figure 13B:
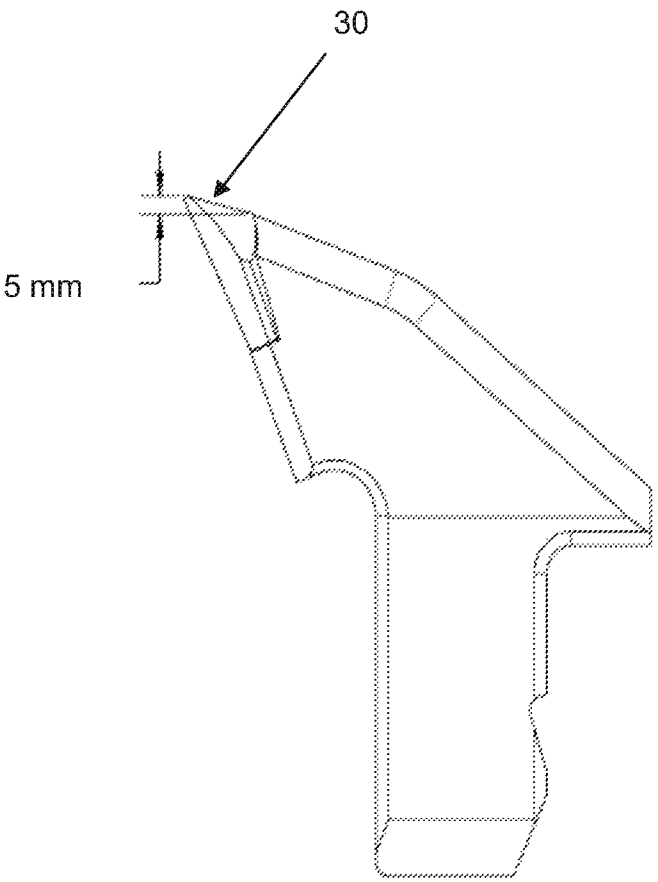
FIG. 13B is a side elevation view of the cutter bit in FIGS. 8-13A, wherein the cutter bit is attached to a mineral bit and the penetration tip is elevated above the transition between rear and top surfaces thereof.
Figure 13A:
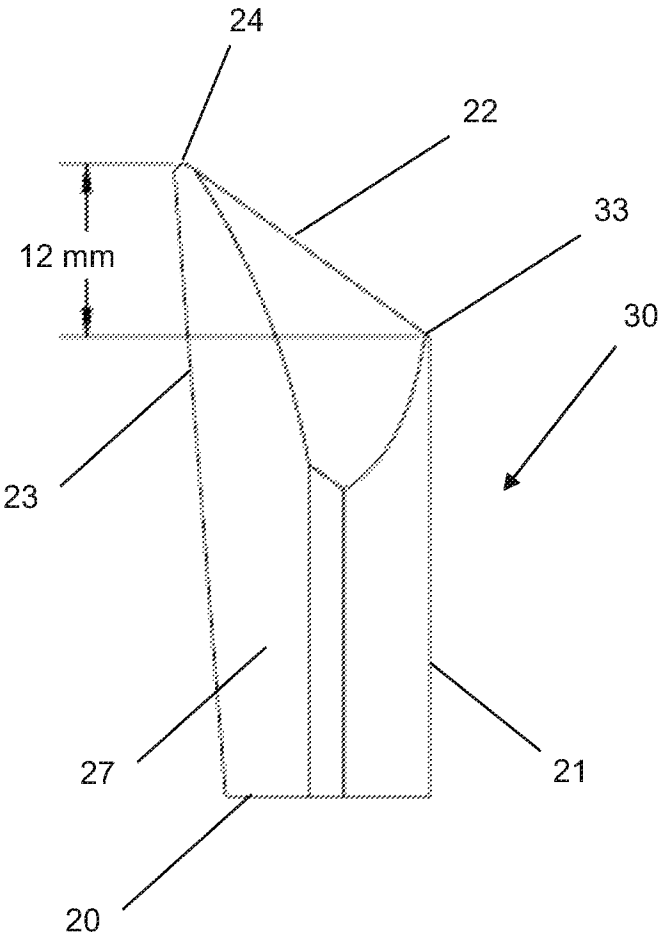
FIG. 13A is a side elevation view of the cutter bit in FIGS. 8-12B, wherein the penetration tip is elevated above the transition between rear and top surfaces thereof.

Turning to FIG. 13A, the penetration tip 24 may be elevated above the transition 33 between the rear surface 21 and the top surface 22 with a minimum distance of about 12 mm generally perpendicular to the cutting tip base 20. When mounted into a bit, for example, the head portion 1, the penetration tip 24 may be elevated above the transition between the rear surface 21 and the top surface 22 with a minimum of approximately 5 mm generally perpendicular to the cutting direction.

In order for the cutting tip 30 to retain its penetration capability during operation, as it wears down, the penetration tip 24 may be elevated above the transition between the rear surface 21 and the top surface 22. This elevation may provide sufficient material to wear away while the cutting tip 30 retains its penetration capability. As the material wears away, the penetration tip 24 is encouraged to wear away but generally retains its penetration capability. The shape and geometry of the cutting tip may permit a self-sharpening of the cutting tip, thereby continuously providing a generally functional penetration tip.

For simplicity and clarity of illustration, where considered appropriate, reference numerals may be repeated among the figures to indicate corresponding or analogous elements. In addition, numerous specific details are set forth in order to provide a thorough understanding of the examples described herein. However, it will be understood by those of ordinary skill in the art that the examples described herein may be practiced without these specific details. In other instances, well-known methods, procedures and components have not been described in detail so as not to obscure the examples described herein. Also, the description is not to be considered as limiting the scope of the examples described herein.

It will be appreciated that the examples and corresponding diagrams used herein are for illustrative purposes only. Different configurations and terminology can be used without departing from the principles expressed herein. For instance, components and modules can be added, deleted, modified, or arranged with differing connections without departing from these principles.

The specific dimensions in the figures are for illustration only and other suitable dimensions employed in accordance with this disclosure will also work in respect of other embodiments.

Although the above principles have been described with reference to certain specific examples, various modifications thereof will be apparent to those skilled in the art as outlined in the appended claims.

The invention claimed is:

1. A mineral bit having a body with a cutting tip attachment face for releasably retaining a cutting tip, the cutting tip attachment face being a concave surface and extending across the entire attachment face spanning from one side surface to the other side surface of the body for engaging a convex rear surface of the cutting tip, wherein the cutting tip attachment face is configured to be opposite a cutting face of the cutting tip.

2. The mineral bit of claim 1 wherein the concave surface is arcuate.

3. The mineral bit of claim 1, wherein the attachment face is defined in a leading face of a head portion of the mineral bit.

4. The mineral bit of claim 1, wherein the attachment face is of a non-uniform shape.

5. The mineral bit of claim 1, wherein the cutting tip is attached to the attachment face by fitting a brazing material provided between a flat surface on the cutting tip and a mating surface on the leading face of the mineral bit.

6. The mineral bit of claim 1, wherein the cutting tip is made from a carbide material.

7. The mineral bit of claim 6, wherein the carbide material is tungsten carbide.

8. The mineral bit of claim 6, wherein the carbide material is chromium carbide.

9. The mineral bit of claim 1, wherein the mineral bit comprises a planar base surface that intersects the cutting tip attachment surface and engages a planar surface of the cutting tip.

10. The mineral bit of claim 1, wherein a centerline of the cutting tip attachment face is substantially parallel with respect to a surface of the leading face adjacent to the attachment face.

11. The mineral bit of claim 1, wherein a centerline of the cutting tip attachment face is not parallel with respect to a surface of the leading face adjacent to the attachment face.

12. A mineral bit comprising a body having a head portion and a shank, and a cutting tip secured to the head portion, the cutting tip having a base surface free of projections and a convex rear surface each opposing the head portion, wherein the base surface is adjacent the convex rear surface, and wherein the head portion includes a cutting tip attachment face for releasably retaining the cutting tip, the attachment face being a concave surface for mounting-the convex rear surface of the cutting tip.

13. The mineral bit of claim 12, wherein the concave surface is arcuate.

14. The mineral bit of claim 12, wherein a centerline of the attachment face is substantially parallel with respect to a surface of the leading face adjacent to the attachment face.

15. The mineral bit of claim 12, wherein a centerline of the attachment face is not parallel with respect to a surface of the leading face adjacent to the attachment face.

16. The mineral bit of claim 12, wherein the cutting tip is attached to the attachment face by fitting a brazing material provided between a flat surface on the cutting tip and a mating surface on the leading face of the mineral bit.

17. The mineral bit of claim 12 wherein the cutting tip is made from a carbide material.

18. The mineral bit of claim 17, wherein the carbide material is tungsten carbide.

19. The mineral bit of claim 17, wherein the carbide material is chromium carbide.

* * * * *